United States Patent [19]

Olmstead

[11] 4,431,511

[45] Feb. 14, 1984

[54] ENHANCED REMOVAL OF NITROGEN AND SULFUR FROM OIL-SHALE

[75] Inventor: William N. Olmstead, New York, N.Y.

[73] Assignee: Exxon Research and Engineering Co., Florham Park, N.J.

[21] Appl. No.: 453,706

[22] Filed: Dec. 27, 1982

[51] Int. Cl.[3] ..... C10G 1/00

[52] U.S. Cl. ..... 208/11 R

[58] Field of Search ..... 208/11 R

[56] References Cited

U.S. PATENT DOCUMENTS

| | | | |
|---|---|---|---|
| 1,674,420 | 6/1928 | Trumble | 201/35 |
| 1,958,918 | 5/1934 | Karrick | 201/9 |
| 2,435,746 | 2/1948 | Jones | 208/11 R |
| 3,051,644 | 8/1962 | Friedman et al. | 208/11 R |
| 3,118,746 | 1/1964 | Stratford | 48/197 R |
| 4,166,022 | 8/1979 | Tsai | 208/11 R |

*Primary Examiner*—Delbert E. Gantz
*Assistant Examiner*—Lance Johnson
*Attorney, Agent, or Firm*—Henry E. Naylor

[57] ABSTRACT

Disclosed is a method for enhancing the removal of nitrogen, sulfur, or both from oil-shale. The oil-shale is treated with either (i) steam at a temperature from about 250° C. to about 350° C. to remove nitrogen; or (ii) water at a temperature from about 200° C. to about 350° C. to remove both nitrogen and sulfur.

8 Claims, No Drawings

ENHANCED REMOVAL OF NITROGEN AND SULFUR FROM OIL-SHALE

FIELD OF THE INVENTION

The present invention relates to enhancing the removal of nitrogen, sulfur, or both, from oil-shale by treating the oil-shale with: (i) steam at a temperature from about 250° C. to about 350° C.; or (ii) water at a temperature from about 200° C. to about 350° C. When water is employed, both nitrogen and sulfur are removed from oil-shale; when steam is employed, only nitrogen is removed.

BACKGROUND OF THE INVENTION

Oil-shale, one of the leading energy sources under investigation for the production of synthetic fuels, may play a leading role in the energy future of the United States. The primary reason for the growing importance of oil-shale, as well as coal, is the rapid depletion of known petroleum and natural gas reserves. These known reserves are being depleted at a faster rate than the rate of discovering new reserves. As the era of petroleum growth draws to a close, the world's energy mix will have to change. Transition energy sources will be needed as a bridge between petroleum and the potentially unlimited energy sources of the future; such sources being, for example, solar power and nuclear fusion. Owing to their great abundance, coal and oil-shale are perceived as the keystones of such a bridge. Consequently, a great deal of research and development is presently in progress to provide economical ways of converting those energy sources to valuable liquids and gases.

Generally, oil is produced from oil-shale by

Generally, oil is produced from oil-shale by heating the oil-shale in either a fixed or moving bed reactor at a temperature from about 450° C. to 550° C. for a long enough time to convert the organic matter to oil, gas, and residual carbon on spent shale. Although myriad other processes exist for obtaining oil from oil-shale, all of these processes result in a shale-oil which faces severe problems in up-grading owing to a high concentration of nitrogen compounds in the shale-oil; and spent oil-shale having an unacceptable level of nitrogen, sulfur or both. This nitrogen and sulfur could lead to $NO_x$ and $SO_x$ pollutants if the spent oil-shale is combusted for its fuel value.

SUMMARY OF THE INVENTION

In accordance with the present invention, there is provided a method for enhancing the removal of nitrogen, sulfur, or both, from oil-shale. If only nitrogen removal is to be enhanced, the process comprises contacting the oil-shale with steam at a temperature from about 250° C. to about 350° C. If both nitrogen and sulfur removal are to be enhanced, the process comprises contacting the oil-shale with water at a temperature from about 200° C. to about 350° C. In both instances, the resulting effluents will contain nitrogen moieties, sulfur moieties, or both, and will be separated from the treated oil-shale.

In one embodiment of the invention, the oil-shale is contacted with a mixture of steam and water.

DETAILED DESCRIPTION OF THE INVENTION

The general composition and characteristics of oil-shale are well known and will therefore not be described in detail herein. For practical purposes, the oil-shale should contain at least 10, preferably at least about 20, and more preferably between about 25 and 75 gallons of oil per ton of oil-shale, by Fischer Assay.

Although the present invention may be practiced on any known oil-shale, some oil-shales, such as Rundle oil-shale from Australia, have been found to have a higher proportion of its nitrogen in a chemical form which enhances its removal with water or steam.

Although the particle size of oil-shale is not critical, it is preferred for convenience of handling that the oil-shale be crushed to a particle size having an average diameter of less than about 1 inch; preferably less than about ½ an inch. The diameter of the particles as referred to herein is the smallest size of the screen opening through which particles of the designated "diameter" will pass.

If the oil-shale is treated with water to enhance the removal both nitrogen and sulfur, the crushed oil-shale is fed into a high pressure reaction vessel and contacted with water at (a) a temperature from about 200° C. to about 350° C., preferably from about 225° C. to about 350° C.; (b) with a sufficient amount of water and (c) for an effective solids residence time. The term, sufficient amount of water, as used herein, means at least the minimum amount of water needed to form a two phase (liquid and solid) slurry system with the oil-shale. Preferably, no more than 50 parts of water to 1 part of oil-shale, by weight, will be employed. The term effective solids residence time, as employed herein, means for that amount of time which will result in the removal of a predetermined amount of nitrogen and sulfur. The specific amount of time required can be determined by routine experimentation by one having ordinary skill in the art and therefore will not be discussed in further detail herein.

At the temperature employed herein, a mixture of water and steam will be present in the reaction vessel, and nitrogen from the oil-shale will be in the form of ammonia in both the water and the steam phase and sulfur from the oil-shale will be in predominantly the water phase.

In general, the removal of nitrogen and sulfur from oil-shale with water may be accomplished by either a batch or a continuous process. That is, if a continuous process is desired, water and oil-shale may be fed into the reaction vessel for an effective residence time, and steam and water effluents may be continuously removed. The steam effluent will contain nitrogen from the oil-shale in the form of ammonia. The water effluent will contain nitrogen from the oil-shale in the form of ammonia, as well as sulfur from the oil-shale. Of course, the reaction vessel builds-up a certain amount of pressure which is dependent on the temperature.

At the more severe conditions at which the present invention may be practiced, that is at temperatures greater than about 300° C., a small effluent hydrocarbon stream may be produced. Nitrogen and sulfur moieties from the oil-shale may also be contained in such an effluent. These nitrogen and sulfur moieties may have to be removed from the oil, depending on the end use of the oil.

If it is desired to remove the nitrogen, which is in the form of ammonia, and sulfur, from the water effluent, any conventional method suitable for such purpose may be used. One such method which may be employed for removing nitrogen from the water effluent would be to bubble an inert gas through the water effluent, thereby removing the ammonia in the evolving gases. One method which may be employed for removing both ammonia and sulfur from the water effluent would be to bubble carbon dioxide through the water effluent.

The treated oil-shale, which now contains a lower level of nitrogen and sulfur, can be passed along for retorting to convert organic material of the oil-shale to predominantly liquids. One such retorting, or conversion process, which may be employed herein comprises heating the treated oil-shale, either alone or with a solvent, at a temperature from about 450° C. to about 550° C. for an effective period of time in an appropriate reactor. Non-limiting types of reactors which may be employed include fixed, moving, and fluid bed reactors. The term effective period of time means, for a time long enough to convert a substantial portion of the organic material to predominantly liquids.

Spent shale, which is the solid residue resulting from a retort process, usually contains up to about 3 percent by weight, or more, of carbon,. This spent shale can be used as a combustible fuel source at the plant. By practice of the present invention, the resulting spent shale will have a lower nitrogen and/or sulfur content, and consequently, when combusted, will generate lower levels of nitrogen and/or sulfur oxides as pollutants. Furthermore, the shale-oil resulting from subsequent conversion processing of the oil-shale treated in accordance with the present invention, will contain fewer nitrogen and/or sulfur moieties than it would have otherwise contained. Therefore, a higher quality shale-oil is produced which will require relatively mild upgrading.

If steam at atmospheric pressure is employed in the practice of the present invention, only nitrogen removal is enhanced from certain oil-shales. One example is Rundle oil-shale from Australia which is porous enough to allow steam at atmospheric pressure to come into contact with a substantial amount of the oil-shale. Colony oil-shale, from Colorado, has been found by the inventor hereof to have such little porosity that steam at atmospheric pressure has little or no effect on the removal of nitrogen.

When a suitable oil-shale is treated with steam in accordance with the present invention, the oil-shale is fed into a reaction vessel and contacted with the steam at a temperature from about 250° C. to about 350° C., preferably from about 300° C. to about 350° C. for an effective amount of time. Although it is preferred to use steam at atmospheric pressure, it is understood that one may use elevated pressures up to the point at which the steam begins to condense at the operating temperature employed.

Any type of reaction vessel may be employed which would be suitable for treating oil-shale with steam at atmospheric, or greater than atmospheric pressure. For example, an open reaction vessel may be employed for treating oil-shale with steam at atmospheric pressure.

Of course, if pressures in excess of the condensation point of the steam are employed, then the oil-shale will actually be in contact with both water and steam and both nitrogen and sulfur will be removed in the water phase.

In any case, some of the nitrogen from the oil-shale will be converted to ammonia and will be removed in the effluent steam stream. The ammonia can then be separated from the effluent by any suitable technique. One such technique comprises scrubbing the effluent stream with a dry acid such as HCl.

The treated oil-shale may then be passed along to a retorting process for obtaining predominantly liquids from the organic material of the oil-shale.

The following examples will serve to more fully describe the manner of practicing the above-described invention, as well as to set forth the best modes contemplated for carrying out various aspects of the invention. It is to be understood that these examples in no way serve to limit the true scope of this invention, but rather, are presented for illustrative purposes.

COMPARATIVE EXAMPLE A 40 g of Rundle oil-shale (−16/+60 mesh) was fed into a fixed bed pyrolysis reactor and heated to 300° C. at a rate of 7.5° C./min. The oil-shale was held at 300° C. for 90 minutes. The amount of nitrogen removed from the oil-shale is shown in Table I below.

EXAMPLES 1 TO 3

Three runs were conducted in which 40 g of oil-shale for Examples 1 and 3, and 15 g of oil-shale for Example 2, were fed into the fixed bed pyrolysis reactor as in Example 1 above. The oil-shale was heated with helium as a sweep gas to 300° C. at a rate of 7.5° C./min. When a temperature of 200° C. was reached, steam at atmospheric pressure was introduced into the reactor. The oil-shale, with flowing steam and helium, was maintained at 300° C. for 60 minutes for Examples 1 and 2 and 180 minutes for Example 3, afterwhich the steam was shut-off and the oil-shale with the helium sweep was maintained at 300° C. for an additional 30 minutes. The precise conditions and nitrogen removal results are shown in Table I below.

COMPARATIVE EXAMPLE B 40 g of Colony oil-shale from Colorado (−10/+16 mesh) was fed into the reactor and heated as described in Comparative Example A except the oil-shale was maintained at 300° C. for 210 minutes. The results of nitrogen removal can be found in Table I below.

EXAMPLE 4

40 g of Colony oil-shale (−10/+16 mesh) was fed into the pyrolysis reactor and heated as in the above Comparative Example except that during heating to 300° C., steam at atmospheric pressure was introduced at 200° C. and the sample was maintained at 300° C. for 180 minutes with steam flowing and an additional 30 minutes without steam flowing. The precise conditions and result of nitrogen removal are found in Table I below.

TABLE I

REMOVAL OF NITROGEN WITH STEAM

| Example | Shale (mesh) | wt. steam / wt. shale | wt. % N Removal[a] (± 2 wt. %) |
|---|---|---|---|
| Comp. Ex. A | Rundle (−16/+60) | — | 7 |
| Ex. 1 | Rundle (−16/+60) | 0.8 | 18 |
| Ex. 2 | Rundle (−16/+60) | 2.1 | 18 |
| Ex. 3 | Rundle (−16/+60) | 4.3 | 23 |
| Comp. Ex. B | Colony (−10/+16) | — | 6 |

TABLE I-continued

REMOVAL OF NITROGEN WITH STEAM

| Example | Shale (mesh) | wt. steam / wt. shale | wt. % N Removal[a] (± 2 wt. %) |
|---|---|---|---|
| Ex. 4 | Colony (−10/+16) | 3.3 | 3 |

[a]Based on the total amount of nitrogen in the oil-shale.

This table illustrates that steam may be employed for enhancing the removal of nitrogen from oil-shale having a porosity such as Rundle oil-shale, but has no appreciable effect on oil-shale of little porosity such as Colony oil-shale.

COMPARATIVE EXAMPLES C AND D

For Comparative Example C, 3 g of Rundle oil-shale was placed into a 300 cc autoclave reactor and heated to 250° C. in about 60 minutes and held at that temperature for another 30 minutes. Gaseous effluent was continuously removed throughout the run. This procedure was also followed for Comparative Example D except Colony oil-shale was used. The results of nitrogen and sulfur removal are shown in Table II below.

EXAMPLES 5-8

3 g of oil-shale was used for each of these Examples. 3 g of oil-shale and 150 g of water were placed in a 300 cc autoclave reactor and heated to 250° C. for Examples 5 and 7, and to 275° C. for Examples 6 and 8, in about 60 minutes. The samples were held at such temperatures for 30 minutes while continuously collecting gaseous effluent. The reactor was then cooled to below 100° C. and the liquid effluent separated from the treated oil-shale. The results of nitrogen and sulfur removal are shown in Table II below.

TABLE II

REMOVAL OF NITROGEN AND SULFUR WITH WATER

| Example | Shale | Temp. °C. | Wt. % Removal[a] N | Wt. % Removal[a] S |
|---|---|---|---|---|
| Comp. Ex. C | Rundle | 250 | 7 ± 1 | 4 ± 1 |
| Ex. 5 | Rundle | 250 | 23 ± 6 | 14 ± 2 |

TABLE II-continued

REMOVAL OF NITROGEN AND SULFUR WITH WATER

| Example | Shale | Temp. °C. | Wt. % Removal[a] N | Wt. % Removal[a] S |
|---|---|---|---|---|
| Ex. 6 | Rundle | 275 | 34 ± 2 | 26 ± 3 |
| Comp. Ex. D | Colony | 250 | 2 ± 1 | 7 ± 2 |
| Ex. 7 | Colony | 250 | 8 ± 2 | 32 ± 1 |
| Ex. 8 | Colony | 275 | 14 ± 2 | 40 ± 2 |

[a]Based on the total amount of nitrogen and sulfur in the oil-shale.

What is claimed is:

1. A process for enhancing the removal of nitrogen from an oil-shale which process comprises:

(a) providing an oil-shale having sufficient porosity to allow sufficient contact with steam;

(b) contacting the oil-shale with a medium consisting essentially of steam at a temperature from about 250° C. to about 350° C. thereby removing nitrogen from the oil-shale; and (c) withdrawing the resulting effluents having nitrogen moieties from the oil-shale.

2. The process of claim 1 wherein the oil-shale is contacted with steam at a temperature from about 300° C. to about 350° C.

3. The process of claim 2 wherein the treated oil-shale is retorted at temperatures in excess of about 350° C. to convert organic material in the oil-shale to shale-oil.

4. The process of claim 1 wherein the oil-shale is a Rundle oil-shale.

5. A process for enhancing the removal of nitrogen and sulfur from oil-shale which process comprises:

(a) contacting the oil-shale with a sufficient amount of water to form a two phase system, at elevated pressures sufficient to maintain the water in liquid form, and at a temperature from about 200° C. to about 350° C. thereby removing nitrogen and sulfur from the oil-shale, and (b) withdrawing the resulting effluents having the nitrogen and sulfur from the oil-shale.

6. The process of claim 5 wherein the oil-shale is contacted with water at a temperature from about 250° C. to about 300° C.

7. The process of claim 6 wherein the weight to weight ratio of water to oil-shale is up to about 50 to 1.

8. The process of claim 5 wherein the treated oil-shale is retorted at a temperature in excess of about 350° C. to convert organic material in the oil-shale to shale-oil.

* * * * *